US005145345A

United States Patent [19]

Barito et al.

[11] Patent Number: 5,145,345

[45] Date of Patent: Sep. 8, 1992

[54] MAGNETICALLY ACTUATED SEAL FOR SCROLL COMPRESSOR

[75] Inventors: Thomas R. Barito, East Syracuse; Howard H. Fraser, Jr., Lafayette, both of N.Y.

[73] Assignee: Carrier Corporation, Syracuse, N.Y.

[21] Appl. No.: 664,193

[22] Filed: Mar. 4, 1991

Related U.S. Application Data

[63] Continuation-in-part of Ser. No. 452,287, Dec. 18, 1989, Pat. No. 5,040,956.

[51] Int. Cl.[5] ..... F04C 18/04; F04C 27/00; F16J 15/20

[52] U.S. Cl. ..... 418/55.4; 418/55.5; 418/57; 418/142; 277/80

[58] Field of Search ..... 418/55.4, 55.5, 57, 418/142; 277/80

[56] References Cited

U.S. PATENT DOCUMENTS

| | | | |
|---|---|---|---|
| 3,170,409 | 2/1965 | McLeod et al. | 277/80 |
| 3,306,621 | 2/1967 | Fisher | 277/80 |
| 3,700,248 | 10/1972 | Teske et al. | 277/80 |
| 3,708,177 | 1/1973 | Baermann | 277/80 |
| 3,986,799 | 10/1976 | McCullough | 418/55.5 |
| 3,994,633 | 11/1976 | Schaffer | 418/5 |
| 4,496,303 | 1/1985 | Loubier | 425/571 |
| 4,549,157 | 10/1985 | Loubier | 335/303 |
| 4,645,437 | 2/1987 | Sakashita et al. | 418/55.5 |

FOREIGN PATENT DOCUMENTS

| | | | |
|---|---|---|---|
| 0322894 | 7/1989 | European Pat. Off. . | |
| 0380439 | 8/1990 | European Pat. Off. . | |
| 3422389 | 6/1983 | Fed. Rep. of Germany . | |
| 57-68578 | 4/1982 | Japan | 418/55.4 |
| 59-212571 | 12/1984 | Japan | 277/80 |
| 60-30493 | 2/1985 | Japan | 418/55.4 |
| 63-106388 | 5/1988 | Japan | 418/55.4 |
| 1-106989 | 4/1989 | Japan | 418/55.4 |
| 1-290987 | 11/1989 | Japan . | |
| 2-125989 | 5/1990 | Japan | 418/55.4 |

*Primary Examiner*—John J. Vrablik

[57] ABSTRACT

Seal structure for a scroll compressor is provided with localized magnetic surfaces. The seal is carried by one member and the magnetic surface coacts with a facing ferromagnetic surface to provide a seal therebetween even when the members are axially displaced and where there is orbiting motion therebetween.

17 Claims, 3 Drawing Sheets

MAGNETICALLY ACTUATED SEAL FOR SCROLL COMPRESSOR

BACKGROUND OF THE INVENTION

This application is a continuation-in-part of commonly assigned U.S. patent application No. 452,287 filed Dec. 18, 1989.

In a scroll compressor the trapped volumes are in the shape of lunettes and are defined between the wraps or elements of the fixed and orbiting scrolls and their end plates. The lunettes extend for approximately 360° with the ends of the lunettes defining points of tangency or contact between the wraps of the fixed and orbiting scrolls. These points of tangency or contact are transient in that they are continuously moving towards the center of the wraps as the trapped volumes continue to reduce in size until they are exposed to the outlet port. As the trapped volumes are reduced in volume the ever increasing pressure acts on the wrap and end plate of the orbiting scroll tending to axially and radially move the orbiting scroll with respect to the fixed or non-orbiting scroll.

Radial movement of the orbiting scroll away from the fixed or non-orbiting scroll is controlled through radial compliance. Eccentric bushings, swing link connections and slider blocks have all been disclosed for achieving radial compliance. Each approach ultimately relies upon the centrifugal force produced through the rotation of the crankshaft to keep the wraps in sealing contact.

Axial movement of the orbiting scroll away from the fixed or non-orbiting scroll produces a thrust force. The weight of the orbiting scroll, crankshaft and rotor may act with, oppose or have no significant impact upon the thrust force depending upon whether the compressor is vertical or horizontal and, if vertical, whether the motor is above or below the orbiting scroll. Also, the highest pressures correspond to the smallest volumes so that the greatest thrust loadings are produced in the central portion of the orbiting scroll but over a limited area. The thrust forces push the orbiting scroll against the crankcase with a large potential frictional loading and resultant wear. A number of approaches have been used to counter the thrust forces such as thrust bearings and a fluid pressure back bias on the orbiting scroll. Discharge pressure and intermediate pressure from the trapped volumes as well as an external pressure source have been used to provide the back bias. Specifically, U.S. Pat. Nos. 3,600,114, 3,924,977 and 3,994,633 utilize a single fluid pressure chamber to provide a scroll biasing force. This approach provides a biasing force on the orbiting scroll.

The orbiting scroll, which defines a portion of the fluid pressure chamber for providing a back bias, moves axially in going between stopped and running and vice versa. Also, during the running condition the degree of loading, the pressure in the fluid chamber, liquid slugging, etc. can cause axial movement of the orbiting scroll. Seals are used to maintain fluid pressure in the fluid chamber defined between the crankcase and orbiting scroll. In addition to the axial movement of the orbiting scroll with respect to the crankcase, there is also an orbiting movement. To maintain a fluid seal between the orbiting scroll and crankcase, it is necessary to provide a biasing force on the seal. The biasing force may be due to the inherent resiliency of a deformable seal upon its deformation in assembly, a fluid pressure bias on the seal, springs, etc. or a combination of these forces.

Each of these has some inherent deficiencies. A fluid pressure bias must be built up and the seal will be deficient until the pressure is built up thereby delaying the build up. Springs are subject to failure and they and the inherent resiliency place an additional torque on the compressor motor at start up. Tip seals are employed in lieu of a fluid pressure chamber for back biasing and present their own problems such as leakage and wear.

SUMMARY OF THE INVENTION

A seal is provided for use in a scroll compressor having one or more members made of ferromagnetic material requiring sealing. The seal is selectively magnetized to preferentially seal at one or more surfaces with a ferromagnetic member. Selective magnetization is disclosed in U.S. Pat. Nos. 4,496,303 and 4,549,157. The fluid seal exists at start up without requiring a further initial mechanical or fluid pressure bias. Although the magnetic seal may be bounded on all sides by ferromagnetic materials, it is preferentially attracted to the desired ferromagnetic surface(s) such as the orbiting scroll. Specifically, the seal may be located in a groove and be attracted to the facing surface as well as the inner or outer wall of the groove. The seal may act as a tip seal for the wrap of the scroll and/or may be located in a groove in the crankcase and coact with the back of the plate of the orbiting scroll. When used to seal a fluid pressure chamber located between the crankcase and the orbiting scroll, the seal is preferably split to accommodate manufacturing tolerances of the groove and seal, differential thermal changes in the seal and other parts, and to permit resilient and/or magnetic sealing between the seal and groove wall. In sealing a pressure chamber a seal will be preferably located at and form the inner and outer radial boundaries of the pressure chamber.

It is an object of this invention to provide improved seals for scroll compressors.

It is another object of this invention to reduce the starting torque required in scroll compressors.

It is a further object of this invention to provide an internal fluid seal at start up without mechanically or fluidly biasing the seal against the surfaces(s) to be sealed. These objects, and others as will become apparent hereinafter, are provided according to the teachings of the present invention.

Basically, seal structure is provided which is selectively magnetized so as to have one or more surfaces effectively define a localized magnetic surface. The seal is carried by one member and the magnet coacts with a facing ferromagnetic member to provide a seal therebetween even when the members separate. Additionally, a second localized magnetic surface may coact with a surface of a supporting ferromagnetic member to establish a second sealing surface.

BRIEF DESCRIPTION OF THE DRAWINGS

For a fuller understanding of the present invention, reference should now be made to the following detailed description thereof taken in conjunction with the accompanying drawings wherein.

DESCRIPTION OF THE PREFERRED EMBODIMENTS

Figure 1:
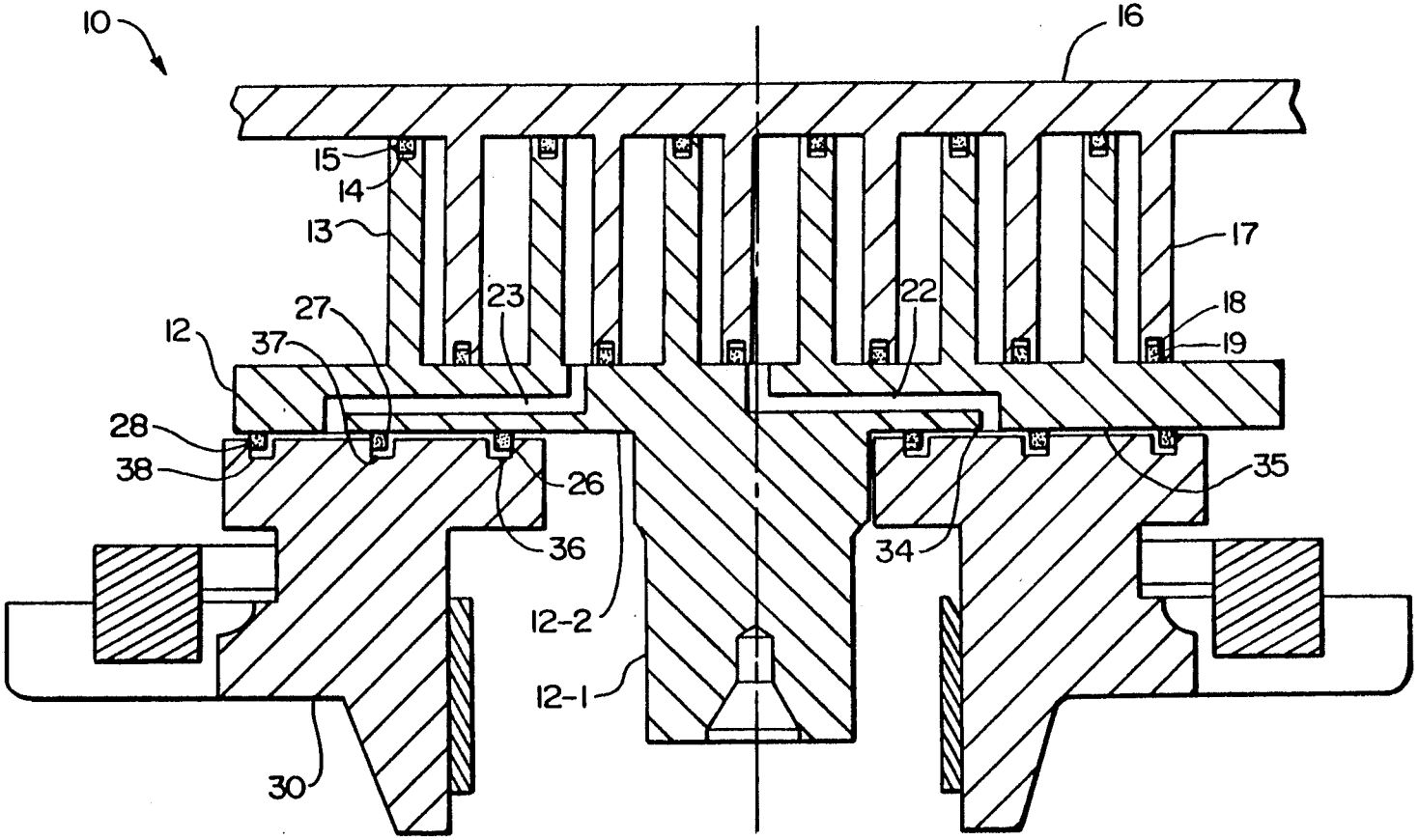
FIG. 1 is a vertical sectional view of a portion of a scroll compressor employing the seals of the present invention with the members being in a position corresponding to the compressor running.
Figure 2:
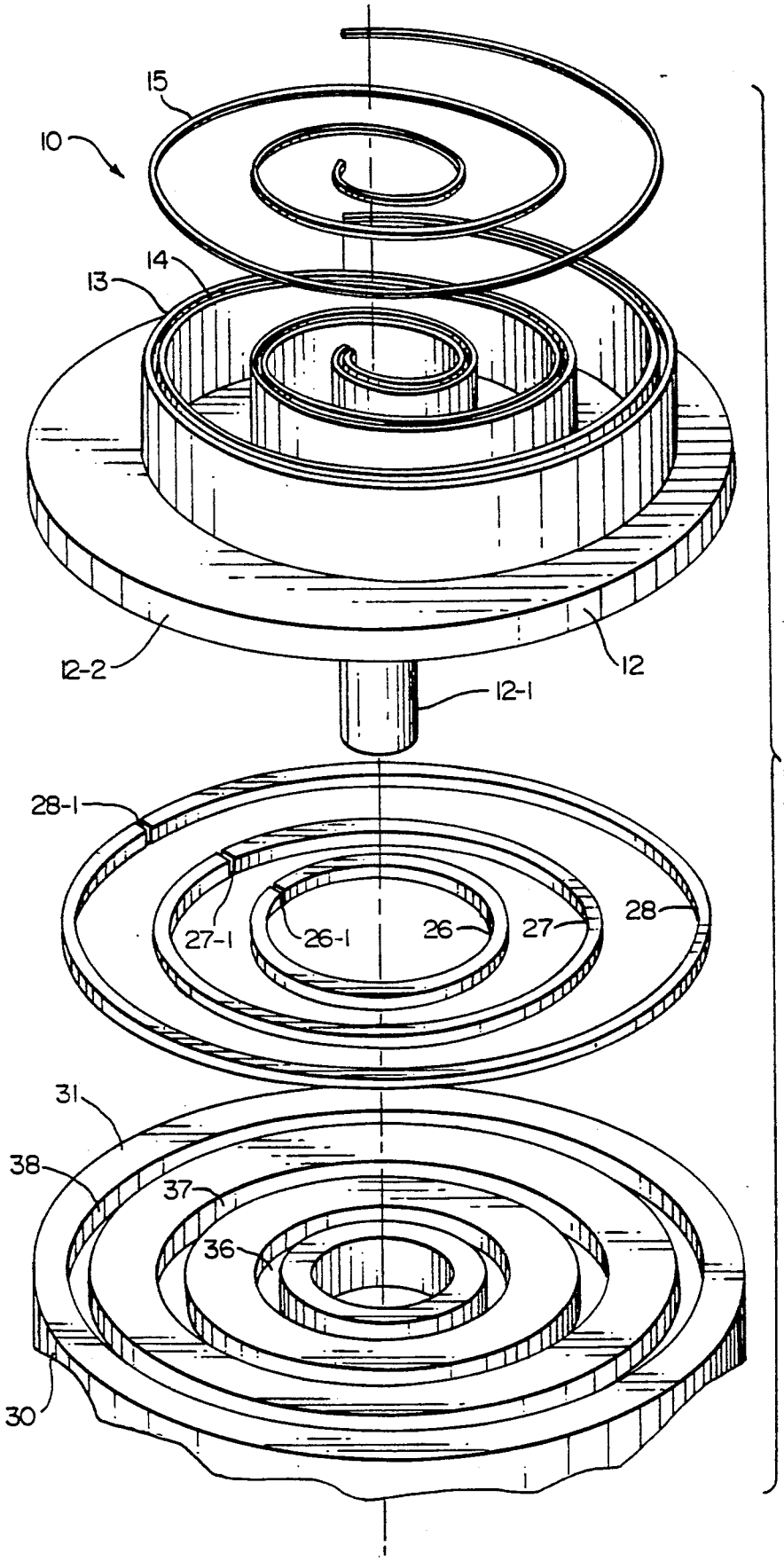
FIG. 2 is an exploded view of the crankcase, orbiting scroll, and seals.

Referring specifically to FIGS. 1 and 2, the numeral 10 generally designates a scroll compressor having an orbiting scroll 12, a relatively fixed or non-orbiting scroll 16 and a crankcase 30. Orbiting scroll 12 and fixed scroll 16 have wraps 13 and 17, respectively, which coact in a conventional manner. Wraps 13 and 17 have grooves 14 and 18, respectively, formed in their tips for receiving tip seals 15 and 19. Orbiting scroll 12 also has a pair of internal passages 22 and 23. Passage 22 extends from a high/discharge pressure region in the compression process to annular pocket or pressure chamber 34 formed between orbiting scroll 12 and crankcase 30. Similarly, passage 23 extends from an intermediate pressure region in the compression process to annular pocket or pressure chamber 35 formed between orbiting scroll 12 and crankcase 30 and located radially outward of chamber 34. Annular seals 26, 27 and 28 are respectively located in annular grooves 36, 37 and 38 which are formed in face 31 of crankcase 30. As will be explained in greater detail below, seals 26, 27 and 28 coact with orbiting scroll 12 and crankcase 30 to define and seal chambers 34 and 35.

Seals 15, 19 and 26–28 are made of injection molded plastic material filled with particles of permanently magnetizable material such that only selective surfaces/regions of the seals may act as permanent magnets. Seals 15 and 19 can be fabricated as rings, spirals or helixes as well as being straight. In any case, manufacturing tolerances, while small, will normally result in at least some deformation of seals 15 and 19 in placing them in grooves 14 and 18, respectively, whereby there will tend to be a resilient biasing of the seals 15 and 19 against the walls of grooves 14 and 18 for at least a portion of their length. The resilient biasing can be against portions of both the inner and outer walls of grooves 14 and 18 depending upon the deformation in assembly. For tip seals 15 and 19, specifically, there will be a minimal clearance with the walls of grooves 14 and 18 because the clearance represents a leak path. Enough clearance must be provided for movement of seals 15 and 19 in grooves 14 and 18.

Figure 6:
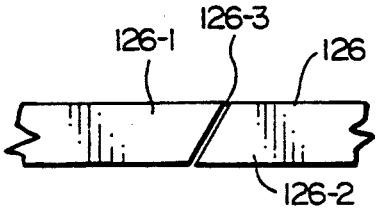
FIG. 6 shows a top view of a second embodiment of the seal ends.
Figure 7:
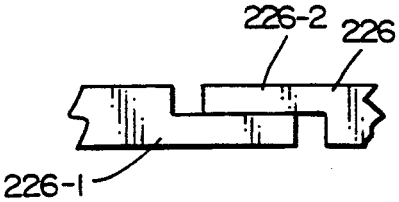
FIG. 7 shows a top view of a third embodiment of the seal ends.

Seals 26–28 and grooves 36–38 are annular, so that unless seals 26–28 are split, any radial deformation and resulting biasing would be due to deforming seals 26–28 in placing them in grooves 36–38. As best shown in FIG. 2, the seals 26–28 are split with radially extending cuts to form gaps 26-1, 27-1 and 28-1 whereby if a seal is smaller than the groove then the seal will tend to be resiliently biased against the inner wall of the groove with a gap between the ends. If a seal is larger than its groove, it will tend to be resiliently biased against the outer wall due to its resilience, but there may be a region near the ends where one or both will be displaced from the outer wall if the required deformation is greater than the dimension of corresponding gap 26-1, 27-1 or 28-1. If a seal fits its groove, the gap will permit it to be magnetically attracted to the inner or outer wall of the groove depending upon the localized magnetizing of the seal. Superimposed upon the resilience of the seal material will be the magnetic attraction between the seal and a wall of the groove and this will ordinarily result in the maximum permissible contact between a magnetic region on the seal and the corresponding wall of the groove. Turning now to FIG. 6, modified seal 126 which is exemplary of all of the annular seals has a non-radial or skewed cut forming ends 126-1 and 126-2 separated by gap 126-3 which permits the ends 126-1 and 126-2 to ride over each other which facilitates assembly where the seal is larger than its groove. Otherwise, seal 126 would function in the same manner as seals 26–28. FIG. 7 shows another modified seal 226 which is exemplary of all of the annular seals. Seal 226 has an inner circumferentially extending portion 226-1 and an outer circumferentially extending portion 226-2 such that when assembled a portion of the circumference of the seal 226 is formed only by 226-1 and other portion of the circumference of the seal 226 is formed only by 226-2 such that an intermediate portion is formed by both 226-1 and 226-2. Portions 226-1 and 226-2 are able to slide over each other such that they are capable of permitting seal 226 to accommodate dimensional differences between a seal and a side wall of a groove against which it is to provide a seal.

Figure 8:
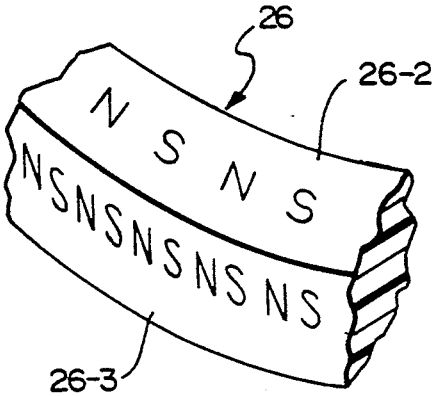
FIG. 8 shows a typical localized magnetic surfaces.

The seals 15, 19 and 26–28 will each have their surface corresponding to the open end of grooves 14, 18 and 36–38 magnetized. In addition, a surface of seals 15, 19 and 26–28 which faces either the inner or outer wall of grooves 14, 18 and 36–38, respectively, may be magnetized. The other surfaces of seals 15, 19 and 26-28 will not be magnetized. A typical magnetic distribution in a seal 26 is shown in FIG. 8. It will be noted that the upper surface or top face 26-2 has fewer poles than the corresponding side wall or circumferential surface 26-3 since it is possible to have many more poles on the side walls than on the top face or vice versa. Additionally, the axial height of seals 15, 9 and 26–28 will be less than the depths of their corresponding grooves 14, 18 and 36–38 so as to prevent the crushing of seals 15, 19 and 26–28 when compressor 10 is not running as well as to avoiding any unnecessary starting torque due to a resilient biasing of the seals against the scrolls.

Figure 3:
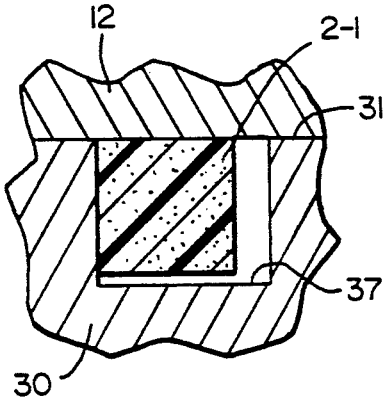
FIG. 3 is an enlarged sectional view of a crankcase seal in a position corresponding to the compressor being stopped.
Figure 5:
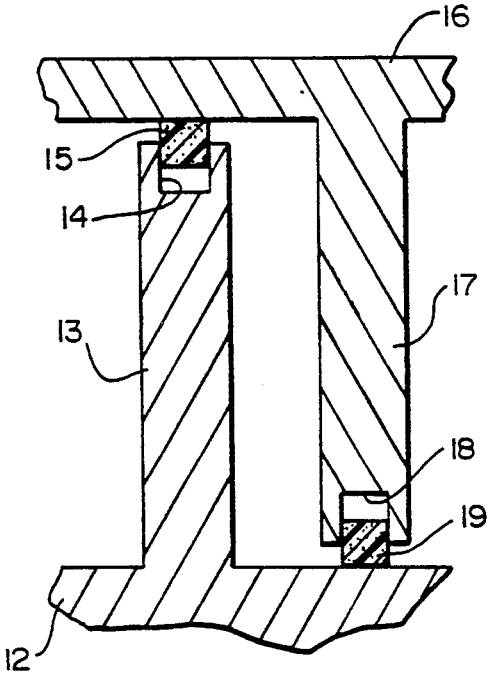
FIG. 5 is an enlarged sectional view of a tip seal in a position corresponding to the compressor being stopped when used in combination with the crankcase seals or running if used alone.

When compressor 10 is not running, orbiting scroll 12 which is of a ferromagnetic material rests on face 31 of crankcase 30. As exemplified by FIG. 3, when orbiting scroll 12 rests on face 31, magnetic attraction between seal 27 and orbiting scroll 12 keeps it attached to orbiting scroll 12 and spaced from the bottom of groove 37 whereby seal 27 provides a sealing function but no bias to orbiting scroll 12. Additionally, the outer surface of seal 27 may be magnetized, as illustrated in FIG. 8, such that it magnetically seals to the outer surface of groove 37 if crankcase 30 is of a ferromagnetic material. When orbiting scroll 12 is resting on crankcase 30, as illustrated in FIG. 3, orbiting scroll 12 separates from fixed scroll 16, as illustrated in FIG. 5. Because scrolls 12 and 16 are ferromagnetic materials, seals 15 and 19, respectively, stay engaged with the facing surfaces of scrolls 12 and 16. Seals 15 and 19 may be magnetically sealed to the inner or outer walls of grooves 14 and 18, but the magnetic attraction together with any biasing due to the resistance of the seals must be of such a value to permit seals 15 and 19 to stay in engagement with the facing scroll surface when scrolls 12 and 16 separate. As noted above, there will be minimal clearances to minimize any leakage path between the tip seals and their grooves.

Figure 4:
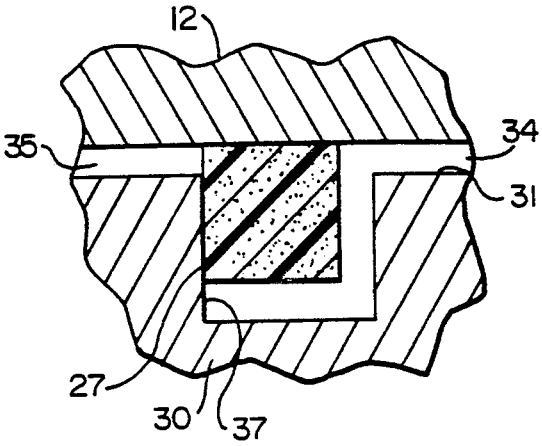
FIG. 4 is an enlarged sectional view of a crankcase seal in a position corresponding to the compressor running.

In operation, orbiting scroll 12 will be driven through hub 12-1 by a motor (not illustrated) through a crankshaft (not illustrated) in a conventional manner. As noted above and illustrated in FIG. 5, seals 15 and 19 seal the tips of wraps 13 and 17 at start up so that compression takes place. As compression takes place, the build up in pressure in the trapped volumes is communicated via passages 22 and 23 to chambers 34 and 35, respectively. The pressure in chambers 34 and 35 acts on orbiting scroll 12 to move it from the position of FIGS. 3 and 5 to the position of FIGS. 1 and 4. As orbiting scroll 12 moves away from crankcase 30 and towards fixed scroll 16, or from the FIG. 3 position to the position of FIGS. 1 and 4, seal 27 moves axially with orbiting scroll 12. To permit this, the magnetic attraction between seal 27 and orbiting scroll 12 must be greater than any magnetic and/or resilient biasing of seal 27 which tends to hold it in place against the outer wall of groove 37. The same coaction between seals 26 and 28 with orbiting scroll 12 would also be necessary and would take place as described with respect to seal 27 except that seal 26 will be held in place against the inner wall of groove 36. Seals 27 and 28 seal against the outer wall of grooves 37 and 38, respectively, while seal 26 seals against the inner wall of groove 26 because of the relative pressures in chambers 34 and 35. Because chamber 34 is at discharge pressure it readily would force seal 26 against the inner wall of groove 36 since the remainder of the interior of the compressor 10 would be at suction pressure. Referring to FIG. 4, the discharge pressure in chamber 34 acting on seal 27 is much greater than the intermediate pressure in chamber 35 acting on seal 27 so that seal 27 is forced against the outer wall of groove 37. The intermediate pressure in chamber 35 acting on seal 28 forces seal 28 against the outer wall of groove 38. Since the fluid pressure in chambers 34 and 35 will determine the radial positions of the seals in their grooves, if the seals are magnetized along the circumference it will be so as to assist the fluid pressure in forming a seal whereby the seals will not be moved radially in the grooves in going between the running and stopped positions of the compressor 10. The seals 26–28 will be sized to eliminate to the extent possible the gaps 26-1, 27-1 and 28-1 that might exist between the ends formed at the radial cuts shown in FIG. 2 upon assembly or in the modified structure of FIGS. 6 and 7. At start up, the only resistance of the seals 15, 19 and 26–28 is the shear force needed to slide the magnetic surfaces relative to their facing surfaces or vice versa. Tip seals 15 and 19 differ from seals 26–28 in that they are located in their grooves in opposite axial positions as will be noted from comparing FIGS. 3 and 5 which represent compressor 10 in its off position. Specifically, as shown in FIG. 5, the tip seals 15 and 19 provide a seal at start up and as the pressure builds up in chambers 34 and 35 to lift orbiting scroll 12 off of crankcase 30, orbiting scroll 12 is forced towards fixed scroll 16 and tip seals 15 and 19 are correspondingly forced into their grooves 14 and 18 as illustrated in FIG. 1. Otherwise, the coaction of seals 15, 19 and 26–28 is the same.

The structure and operation described above is unusual in the use of tip seals in combination with a back pressure bias since they are considered alternative approaches to axial compliance. Further, the operation of the tip seals 15 and 19 differs from their conventional operation in forcing the seals 15 and 19 into their grooves during operation rather than having the seals 15 and 19 in the FIG. 5 positions whether the compressor 10 is running or not. In contrast, as shown in FIG. 1, tip seals 15 and 19 are flush with the tips of wraps 13 and 17, respectively, during operation. The use of the seals of the present invention for both tip seals and crankcase seals minimizes leakage at start up permitting the pressure to more quickly and reliably build up in chambers 34 and 35 due to the tip seals. However, tip seals or crankcase seals may be used alone and still benefit from the advantages of the present invention, but if tip seals were used alone, the orbiting scroll 12 would ride on the crankcase 30, as is conventional.

Although preferred embodiments of the present invention have been illustrated and described, other changes will occur to those skilled in the art. For example, the gaps in the crankcase seals may be located so as to have the ends ride over each other in either the radial plane, as illustrated, or in an axial plane. Also, the seal height, while preferably less than the depth of its corresponding groove, may be equal to or greater than the depth of the groove. Although a fixed and orbiting scroll are described, it should be understood that it is only necessary that one scroll orbit with respect to the other which may also be capable of movement. It is therefore intended that the scope of the present invention is to be limited only by the scope of the appended claims.

What is claimed is:

1. Magnetically actuated seal structure for continuously providing a fluid seal between two relatively axially displaceable members which have a contacting position and a separated position where a first one of said two members is of a magnetic material comprising:

groove means in a second one of said two members having vertical walls and having a depth;

seal means in said groove means having a shape conformable to said groove means;

said seal means having opposing first and second sides with only said first one of said first and second sides being magnetized and said first side defining a first magnetized surface defined by a plurality of alternating north and south poles on said first surface facing said first one of said two members whereby said first magnetized surface of said seal means remains in engagement with said first one of said two members even when they are axially displaced to provide a continuous fluid seal.

2. The seal structure of claim 1 wherein said seal means has a height less than said depth of said groove means.

3. The seal structure of claim 1 wherein said first one of said two members is an orbiting scroll of a scroll compressor having a wrap and a back plate.

4. The seal structure of claim 3 wherein said groove means is in said wrap.

5. The seal of claim 4 further including a supporting member and groove means located in said supporting member facing said back plate and said seal means being additionally located in said groove means in said supporting member.

6. The seal structure of claim 1 wherein said second one of said two members is ferromagnetic and said seal means has a second magnetized surface facing one of said vertical walls of said groove means whereby said second magnetized surface of said seal means remains in engagement with said one vertical wall.

7. The seal structure of claim 6 wherein said first one of said two members is an orbiting scroll of a scroll compressor having a wrap and a back plate.

8. The seal structure of claim 7 wherein said groove means is in said wrap.

9. The seal of claim 8 further including a supporting member and groove means located in said supporting member facing said back plate and said seal means being additionally located in said groove means in said supporting member.

10. The seal structure of claim 1 wherein said seal means is in the form of a split ring.

11. In a scroll compressor means having a first scroll with a wrap, an orbiting scroll facing said first scroll with a wrap for coacting with said wrap of said first scroll and a back plate, and crankcase means for supporting said orbiting scroll with said orbiting scroll being axially movable between a position in contact with said crankcase means and a position axially engaging said first scroll, seal structure comprising:

groove means in each of said wraps and having vertical walls and a depth;

seal means having opposed first and second sides and a shape conformable to said groove means;

each of said seal means being located in said groove means in one of said wraps and having a first magnetized surface on only said first one of said first and second sides with said first magnetized surface being defined by alternating north and south poles on said first surface and facing out from said groove means towards a corresponding one of said first and orbiting scrolls;

said first and orbiting scroll being of ferromagnetic material whereby said seal means are held in sealing engagement with corresponding portions of said first and orbiting scrolls facing said first magnetized surface of said seal means.

12. In a scroll compressor means of claim 11 wherein each of said seal means has a second magnetized surface facing one of said vertical walls of one of said groove means whereby said second magnetized surface of said seal means remains in engagement with said one vertical wall.

13. In a scroll compressor means of claim 11 further comprising:

groove means in said crankcase means having vertical walls and a depth;

second seal means having a shape conformable to said groove means in said crankcase means;

said second seal means being located in said groove means in said crankcase means and having a magnetized surface facing out from said groove means in said crankcase means towards said back plate of said orbiting scroll whereby said magnetized surface of second seal means remains in engagement with said orbiting scroll even when said orbiting scroll and crankcase means are axially displaced.

14. In a scroll compressor means of claim 11 wherein said seal means has a height less than said depth of said groove means.

15. In a scroll compressor means having a first scroll with a wrap, an orbiting scroll facing said first scroll, said orbiting scroll having a wrap for coacting with said wrap of said first scroll and a back plate, and crankcase means for supporting said orbiting scroll and defining there with fluid pressure pocket means with said orbiting scroll being axially movable between a position in contact with said crankcase means and a position axially engaging said first scroll, seal structure comprising:

said orbiting scroll being of magnetic material;

groove means in said crankcase means having vertical walls and having a depth;

seal means in said groove means having a shape conformable to said groove means;

said seal means having opposing first and second sides with only said first one of said first and second sides being magnetized and said first side defining a first magnetized surface defined by a plurality of alternating north and south poles on said first surface facing said orbiting scroll whereby said first magnetized surface of said seal means remains in engagement with said orbiting scroll, even when said orbiting scroll is axially displaced from said crankcase, to thereby coact with said orbiting scroll and crankcase means to define said fluid pressure pocket means.

16. In a scroll compressor means of claim 15 wherein said crankcase means is ferromagnetic and said seal means has a second magnetized surface facing one of said vertical walls of said groove means whereby said second magnetized surface of said seal means remains in engagement with said one vertical wall.

17. In a scroll compressor means of claim 15 wherein said seal means is in the form of a split ring.

* * * * *